US007614511B2

(12) United States Patent
Konstant

(10) Patent No.: US 7,614,511 B2
(45) Date of Patent: Nov. 10, 2009

(54) LOCKING CROSS BAR

(75) Inventor: Anthony N. Konstant, Winnetka, IL (US)

(73) Assignee: Konstant Products, Inc., Rolling Meadows, IL (US)

( * ) Notice: Subject to any disclaimer, the term of this patent is extended or adjusted under 35 U.S.C. 154(b) by 996 days.

(21) Appl. No.: 10/858,242

(22) Filed: Jun. 1, 2004

(65) Prior Publication Data

US 2006/0163185 A1 Jul. 27, 2006

(51) Int. Cl.
*A47B 43/00* (2006.01)

(52) U.S. Cl. ..... 211/189; 211/191; 211/192

(58) Field of Classification Search ..... 211/189, 211/191, 192; 248/346.3, 165; 108/901, 108/202; 312/265.1; 220/4.28; 280/47
See application file for complete search history.

(56) References Cited

U.S. PATENT DOCUMENTS 3,042,221 A * 7/1962 Rasmussen ..... 211/183
3,463,325 A * 8/1969 Zagotta et al. ..... 211/191
4,078,664 A * 3/1978 McConnell ..... 211/189
4,285,436 A * 8/1981 Konstant et al. ..... 211/192
4,955,490 A * 9/1990 Schafer ..... 211/187
5,011,031 A * 4/1991 Konstant ..... 211/191
5,279,431 A * 1/1994 Highsmith et al. ..... 211/189
5,628,415 A * 5/1997 Mulholland ..... 211/189
6,497,332 B1 * 12/2002 Konstant ..... 211/189
6,502,702 B1 * 1/2003 Hsue et al. ..... 211/26
2003/0010740 A1 * 1/2003 Konstant ..... 211/189
2003/0155319 A1 * 8/2003 Wishart et al. ..... 211/189

* cited by examiner

*Primary Examiner*—Kambiz Abdi
*Assistant Examiner*—Lindsay M. Maguire
(74) *Attorney, Agent, or Firm*—Niro, Scavone, Haller & Niro

(57) ABSTRACT

A cross bar forming a support surface between parallel deck beams of rack-type storage systems to create storage shelves, the cross bars being lockable and readily removable and reusable.

12 Claims, 6 Drawing Sheets

LOCKING CROSS BAR

BACKGROUND OF THE INVENTION

The present inventions relate generally to shelf-type storage racks systems and, more particularly, to improved cross bars used to create storage shelves. The cross bars of the present inventions are locked or secured against undesired movement without bolts and the like to create a shelf so that loads are properly supported. The locking cross bars are also readily removeable and reusable.

Shelf-type storage racks are widely known in the storage and warehouse industry. Typical shelf-type storage racks include at least four vertical columns rigidly interconnected by generally horizontal deck beams which are positioned in a transverse relation with pairs of columns that are spaced by horizontal and diagonal members commonly referred to as storage rack trusses. The storage rack trusses may be arranged as a series of back-to-back arrays with each array, including the horizontal deck beam, facing an access aisle. As is typical in known, shelf-type systems, a series of wooden slats are placed between the opposing deck beams to form shelves where pallets and other loads may be stored and accessed by warehouse personnel. The front of the shelf is usually adjacent to an access aisle, where warehouse personnel typically use high lifts, fork lifts and the like to place and remove pallets and their loads from the shelves.

As indicated, one common way of creating the storage shelves is the use of wooden slats, typically two-by-fours, as cross bars between the deck beams. When using this method, the front and back deck beams are typically roll formed prior to installation to provide a ridge or lip on their upper surface upon which the wooden slats are placed. However, in this configuration, the slats are prone to being knocked-out, skewed or otherwise misaligned between the deck beams as a result of, among other things, contact with a pallet or fork lift or being otherwise inadvertently disturbed by the warehouse personnel. If this shifting or knock-out of one or more slats is unknown to the warehouse personnel, subsequent placement of a load could result in the load falling, leading to injury to the personnel and/or damages to the load, equipment or rack structure. At best, making sure that the slats are properly positioned between the deck beams is time consuming for the warehouse personnel.

Another method of creating storage shelves using slats is shown and described in U.S. Pat. No. 5,011,031 (incorporated herein by reference). In this method, wooden cross bars are inserted in the channels between the opposing deck beams. Although an improvement, this method has disadvantages such as increased construction costs and decreased flexibility.

Still another known method that may be used to create storage shelves is shown and described in U.S. Pat. No. 6,497,332 B1 (also incorporated herein by reference). This method is particularly useful in storage situations, such as the grocery sector, where only some items stored on a pallet need to be accessed, as opposed to access to the whole load or pallet and its load. Although this system is also an improvement over other known shelf-type storage systems, its configuration is not required in every storage application.

SUMMARY OF THE INVENTION

The present invention preserves the advantages of the various known rack storage systems and the creation of storage shelves, and also provides new features and advantages. For example, the present invention provides a rack storage system having at least one pair of parallel spaced front columns and at least one pair of parallel spaced rear columns. It also has at least one generally horizontal front deck beam interconnected between at least one pair of spaced front columns, the front deck beam including at least one aperture, as well as at least one generally horizontal rear deck beam interconnected between at least two rear columns. At least one locking cross bar interconnects said front and rear deck beams to form a support surface. The cross bar is adapted at a front end to lockingly engage the aperture on the front deck beam. The locking cross bar is also adapted at a rear end to engage or be supported by the rear deck beam.

In addition, the present invention provides an improved locking cross bar for creating, or that can be used to create, a support surface between front and rear deck beams of a rack-type storage system. For example, the present invention provides a rack storage system having at least one locking cross bar having a support surface, a front end and a back end. Means are provided on the front end of the locking cross bar for securing the locking cross bar to the front deck beam to prevent undesired movement of the cross bar, as well as means on the front deck beam to cooperate with said securing means. Securing means may also include a locking tab, hook, lip or other structure to engage the front deck beam cooperating means. Means on the back end of the locking cross bar to prevent undesired movement, lock and/or be supported by the rear deck beam may also be provided.

Accordingly, an object of the present invention is to provide rack storage systems using cross bars to securely create shelves between opposing deck beams that support loads or loads stored on pallets.

Another object of the present invention is to provide locking cross bars that are secured or locked to at least the front and/or rear deck beam to prevent unwanted movement, knock-out or skewing.

Still another object of the present invention is to provide cross bars that may be securely installed without the use of nuts and bolts, welding and the like.

Still yet another object of the present invention is to provide cross bars that are easily installed, locked against undesired movement, and yet are easily removable and reusable.

Yet another object of the present invention is to provide locking cross bars that may be constructed from a variety of standard structural members having a variety of cross sections.

A further object of the present invention is to provide a cross bar that may easily lock to the front and/or rear deck beams using a variety of locking means and methods that prevent undesired movement and permit removal and reuse if desired.

Yet a further object of the present invention is to provide locking cross bars that can be retrofitted into existing rack storage systems without major modification to the front and/or rear deck beams or the disassembly of all or substantial portions of the rack system.

Still a further object of the present invention is to provide an improved locking cross bar system to create shelves for rack storage structures that saves costs, provides adequate strength, enables system flexibility, and is dependable.

Inventor's Definition of the Terms

The terms used in the claims of this patent are intended to have their broadest meaning consistent with the requirements of law. Where alternative meanings are possible, the broadest meaning is intended. All words used in the claims are intended to be used in the normal, customary usage of grammar and the English language.

BRIEF DESCRIPTION OF THE DRAWINGS

The stated and unstated features and advantages of the present inventions will become apparent from the following descriptions and drawings wherein like reference numerals represent like elements in the various views, and in which.

DETAILED DESCRIPTION OF PREFERRED EMBODIMENTS

Set forth below is a description of what is currently believed to be the preferred embodiments or best representative examples of the inventions claimed. Future and present alternatives and modifications to the embodiments and preferred embodiments are contemplated. Any alternatives or modifications which make insubstantial changes in function, purpose, structure or result are intended to be covered by the claims of this patent.

Figure 1:
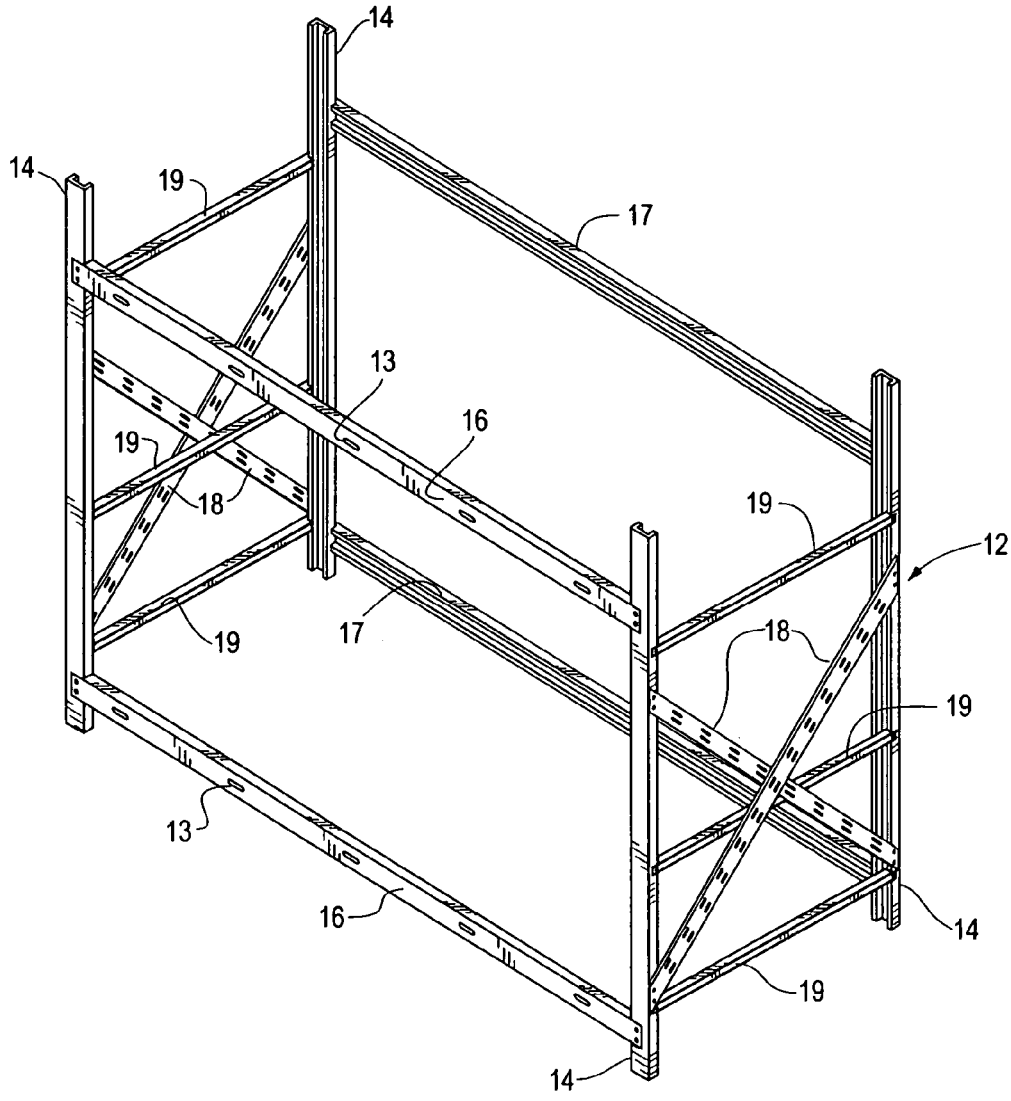
FIG. 1 is a side perspective view of a typical storage rack system and showing an example of a front deck beam modified in accordance with an embodiment of the present invention.

The structural components and configuration of a typical storage rack truss 12 is shown generally in FIG. 1. Such components include a plurality of spaced parallel columns 14, a plurality of generally horizontal front deck beams 16 (FIG. 1 also showing a modification, i.e. apertures, holes or slots 13, to the front deck beams 16 consistent with a preferred embodiment of the present invention) interconnecting front columns 14, and a plurality of generally horizontal rear deck beams 17 that interconnect the rear columns 14. Support braces 18 and lateral support members 19 may also be provided consistent with load and design requirements.

Usually, there is a front side of the system which is adjacent to an access aisle and a back side of the system to which there is typically no access. However, as will be understood by those of skill in the art, the present inventions may be readily adapted for applications where access to both sides of the storage rack 12 is required. For sake of clarity, however, the present inventions will be described in detail by reference to shelf-type storage systems that are accessed only from one side, that is, the front or access aisle.

It will be understood by those of skill in the art that the structural components of storage rack truss system 12 may be selected from a wide variety of materials (e.g., iron, steel or aluminum) having a variety of cross-sectional shapes (such as channels, angles, tubing, I-beams and S-beams). Front and rear deck beams 16 and 17 of the preferred embodiments are described herein as constructed from standard structural members having a channel cross section, which is fairly typical in the industry.

Figure 2:
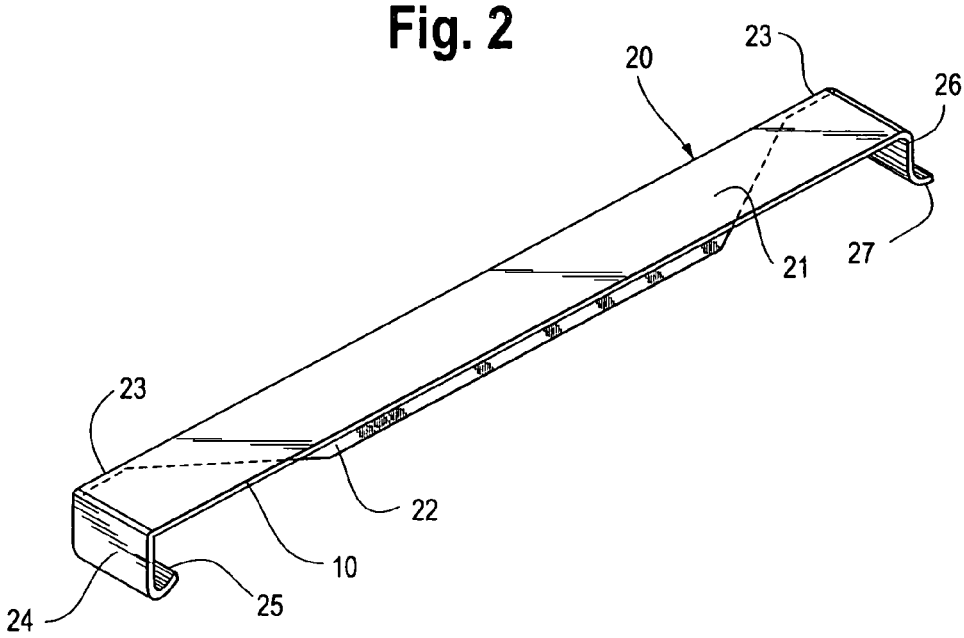
FIG. 2 is a side perspective view of an embodiment of a locking cross bar of the present invention.
Figure 3:
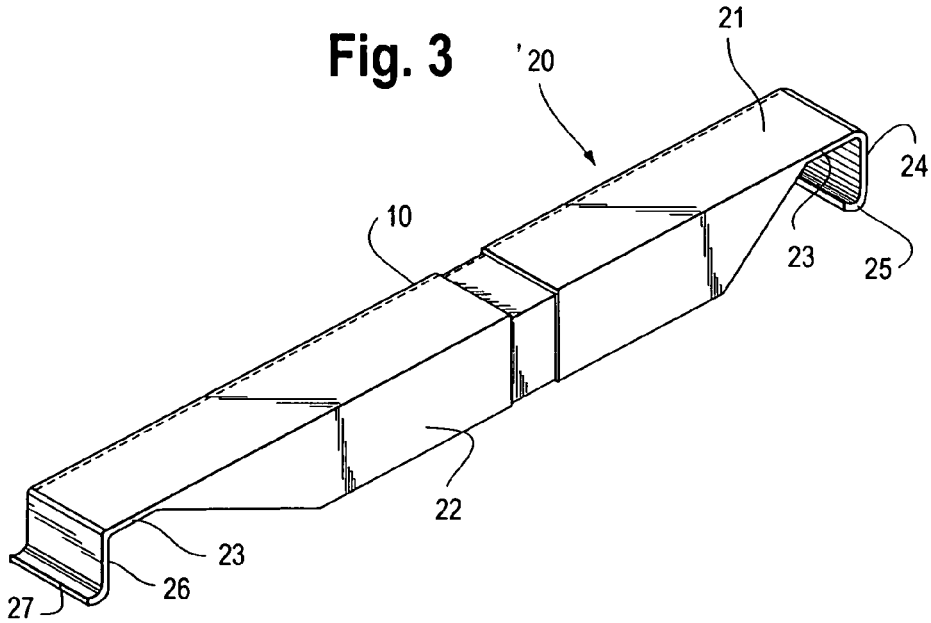
FIG. 3 is a reverse side perspective view of the locking cross bar embodiment of FIG. 2.

Shown generally in FIGS. 2 and 3 is one embodiment of locking cross bar 20. Locking cross bar 20 spans between front deck beam 16 and rear deck beam 17. Locking cross bar 20 provides, among other things, a support surface 21. When installed, one or more locking cross bars 20 form a shelf or deck upon which pallets (not shown) or loads (not shown) may be placed for storage and access. As will be understood by those of ordinary skill in the art, the strength, spacing and number of locking cross bars 20 will depend upon design considerations such as the loads to be stored and size of the truss system 12, etc. It will also be understood that sheeting materials may be placed upon the cross bars 20, if desired.

Similarly, locking cross bars 20 are described herein as being fabricated from standard structural members having a right angular cross section, one flange 10 of which is horizontally oriented so that it provides a support surface 21. However, these particular standard structural components are not required to practice the inventions, as other structural members of different cross sections may also be advantageously fabricated and employed to practice the claimed inventions.

In a preferred embodiment, front deck beam 16 (see FIGS. 4 and 9) includes a vertical web with an outer face 30 and a top flange 31 having an inner edge 34. The distance between face 30 and inner edge 34 of top flange 31 generally defines a flange or support width 32. Front deck beam 16 also includes a lower flange 33 that is opposed to upper flange 31 and has flange width 32. Because the preferred front deck beam 16 is constructed from a standard structural channel, top flange 31 and lower flange 33 generally have the same flange width or support structure 32, subject to manufacturing and/or rolling tolerances. However, equal flange widths, or even the presence of a lower flange 33, are not necessary to practice the inventions. In the preferred embodiment of the present invention, the outer face 30 of front deck beam 16 is also provided with a series of appropriately spaced and sized apertures or slots 13 (see also FIG. 1) which are used to engage a locking tab 25 of locking cross bar 20 as hereinafter described. Notably, this is typically the only modification to the front deck beam (or other components of the rack system 12) required to practice the inventions in their simplest forms.

Rear deck beam 17 (see FIGS. 5 and 9) also has a vertical web with an outer face 36 and a top flange 35 having an inner edge 38. Like the front deck beam 16, the distance between inner edge 38 and face 36 of top flange 35 defines a flange width or support structure 39. Rear deck beam 17 also includes a lower flange 37 that is opposed to upper flange 35 and has a flange width 39. Because in this embodiment rear deck beam 16 is constructed from a standard structural channel member, top flange 35 and lower flange 37 generally have the same flange width 39, subject to manufacturing and/or rolling tolerances. Again, however, equal flange widths 39, or even lower flange 37, are not required to practice the inventions.

One embodiment of locking cross bar 20 of the present invention may be seen in more detail by reference to FIGS. 2 and 3. Locking cross bar 20 includes a horizontal flange 10 that provides a support surface 21 and a vertical flange 22. In order to provide clearance for flange widths 32 and 39 of top flanges 31 and 35, portions of vertical flange 22 are removed from horizontal flange 10 by cutting or other available means. As will be understood by those of skill in the art, a sufficient length of vertical flange 22 must be removed from horizontal flange 10 to enable a front vertical overhang 24 and a back vertical overhang 26 to be formed as hereinafter described. In addition, a sufficient length of horizontal flange 10 must remain after formation of front and back vertical overhangs 24 and 26 to provide for a support leg 23 that is roughly equivalent to or slightly longer than flange widths 32 and 39, upon which they may rest. In other words, after formation of front vertical overhang 24, back vertical overhang 26 and support legs 23, the remaining portion of vertical flange 22 should, within typical manufacturing tolerances, abut (or slightly clear) the inner edge 34 of top flange 31 of front deck beam 16 and the inner edge 38 of top flange 35 of rear deck beam 17.

The remaining portion of vertical flange 22 of locking cross bar 20 includes a front angled portion 28 and a rear angled portion 29 as shown, for example, in FIGS. 2-5. Front angled portion 28 and rear angled portion 29 start at an angle from horizontal support leg 23 that meets the inside edges 34 and 38 of the top flanges 31 and 35 of the front and back deck beams 16 and 17. These angles, although not required, aid in the installation of locking cross bar 20.

In one preferred embodiment, front vertical overhang 24 is formed on one end, i.e., the front end of locking cross bar 20, by bending down a portion of horizontal flange 10 at a point sufficient to clear front face 30 of front deck beam 16, while allowing support leg 23 sufficient length to accommodate flange width 32 and rest upon or be supported by upper flange 31. In one embodiment, front vertical overhang 24 may be bent at an angle slightly greater than 90° to accommodate variations of flange width 32, manufacturing tolerances of locking cross bar 20 and to help secure locking of cross bar 20 as it spans front deck beam 16 and rear deck beam 17. In a preferred form of locking means, a locking tab 25 is formed on front vertical overhang 24. Preferably, locking tab 25 is bent toward the back of cross bar 20 (FIGS. 3 and 4) and is angled slightly upward toward horizontal flange 10 to form a hook shape to help accommodate variations of flange width 32, manufacturing tolerances of locking cross bar 20 and provide secure locking between the front 16 and rear 17 deck beams. A straight or non-hooked locking tab 25 may also be acceptably employed in lieu of the embodiment having a hooked type tab 25.

Locking cross bar 20 also includes a back vertical overhang 26 which is formed by bending down horizontal flange 10 to form support leg 23 at a point sufficient to clear the rear web 36 of rear deck beam 17 while permitting horizontal leg 23 to be sufficient to clear flange width 39 and rest upon or be supported by upper flange 35 of rear deck beam 17. Back vertical overhang 26 may be provided with an optional deflected portion 27 that is bent generally toward the rear of locking cross bar 20 as shown in FIG. 3. Deflected portion 27 may be provided to accommodate variations of flange width 39, variations in the spacing of front deck beam 16 and rear deck beam 17, as well as variations in the fabrication of preferred locking cross bar 20.

Alternatively, it is acceptable to eliminate back vertical overhand 26 (as well as deflected portion 27), such that the rear end of cross bar 20 is simply provided with rear support leg 23, which may rest on or be supported by top flange or support structure 35 of rear deck beam 17. It may also be desirable to bend the flange creating support surface 21, slightly downward between the inner edge 34 of front deck beam 16 and the inner edge 38 of rear deck beam 17, so as to be slightly below top flanges 31 and/or 35. In this manner, horizontal rotation of cross bar 20 and/or the prying of tab 25 out of aperture 13 is further prevented. This is especially desirable in embodiments of locking cross bar 20 that do not incorporate a back vertical overhand 26.

Figure 4:
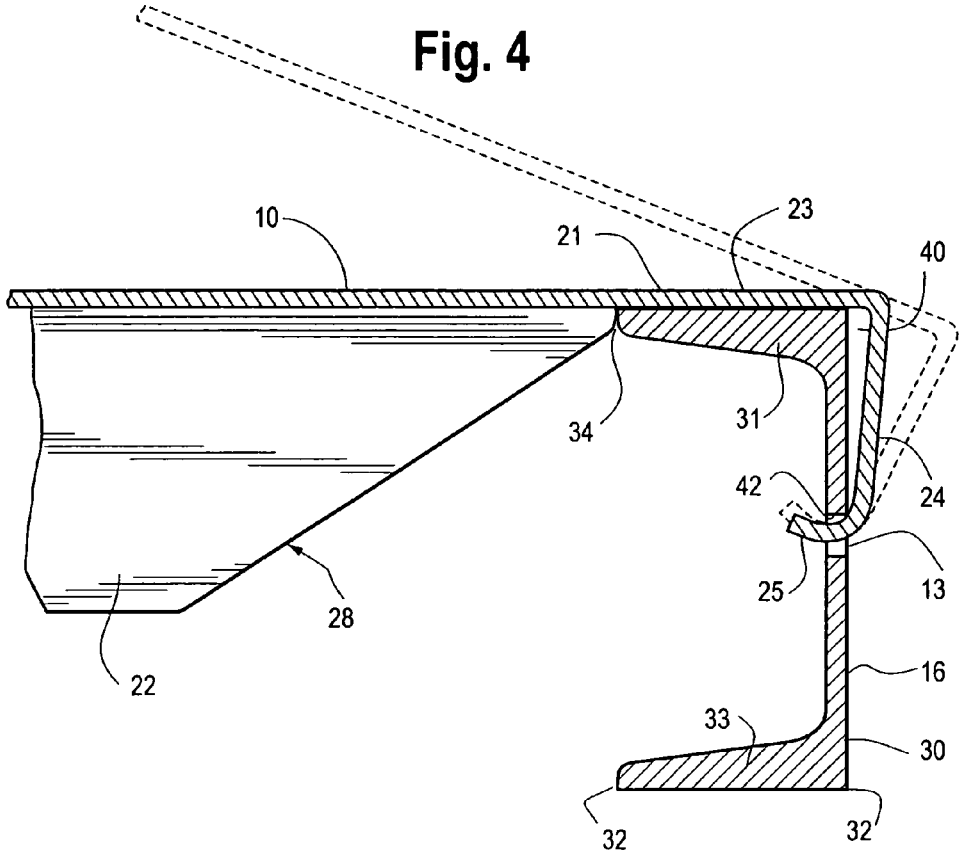
FIG. 4 is a cross sectional view of a locking cross bar of the present invention with the cross bar shown in an initial installation position in phantom lines, and in an installed or locked position on the front deck beam in non-phantom lines.

The installation and operation of one preferred embodiment may be seen by reference to FIGS. 4-9. Front support leg 23, front vertical overhang 24 and locking tab 25 of locking cross bar 20 cooperate with front deck beam 16 and its slots (or other apertures) 13. As shown in FIG. 4, locking tab 25 of front vertical overhang 24 is inserted into slot 13 of front deck beam 16 when locking cross bar 20 is in roughly the position shown in FIG. 6 and in phantom lines in FIG. 4. As locking cross bar 20 is rotated downward (see FIG. 7), the front angled portion 28 clears inner edge 34 of top flange 31.

Figure 5:
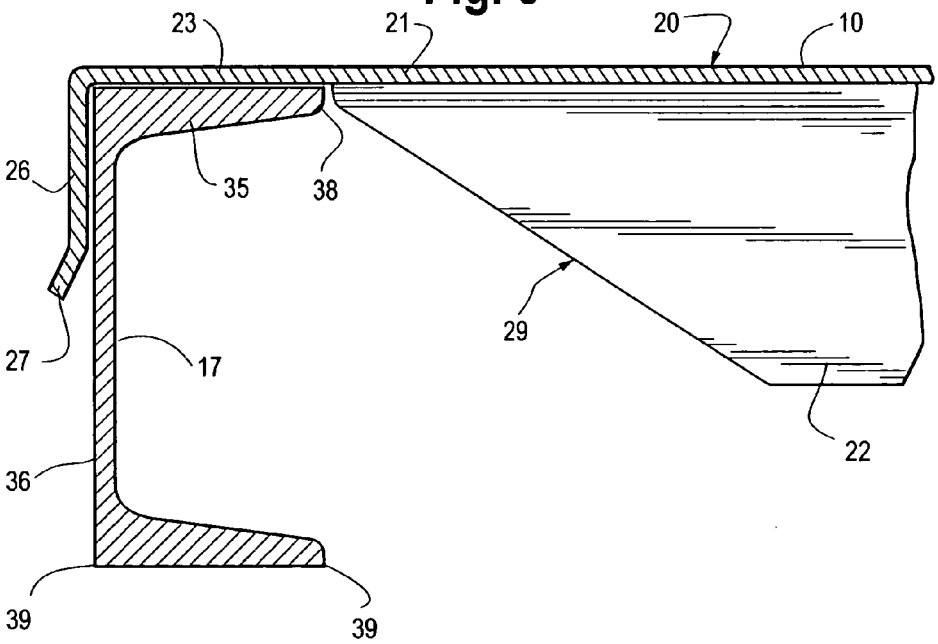
FIG. 5 is a side cross sectional view of a locking cross bar of the present invention shown in an installed position on the back deck beam.
Figure 6:
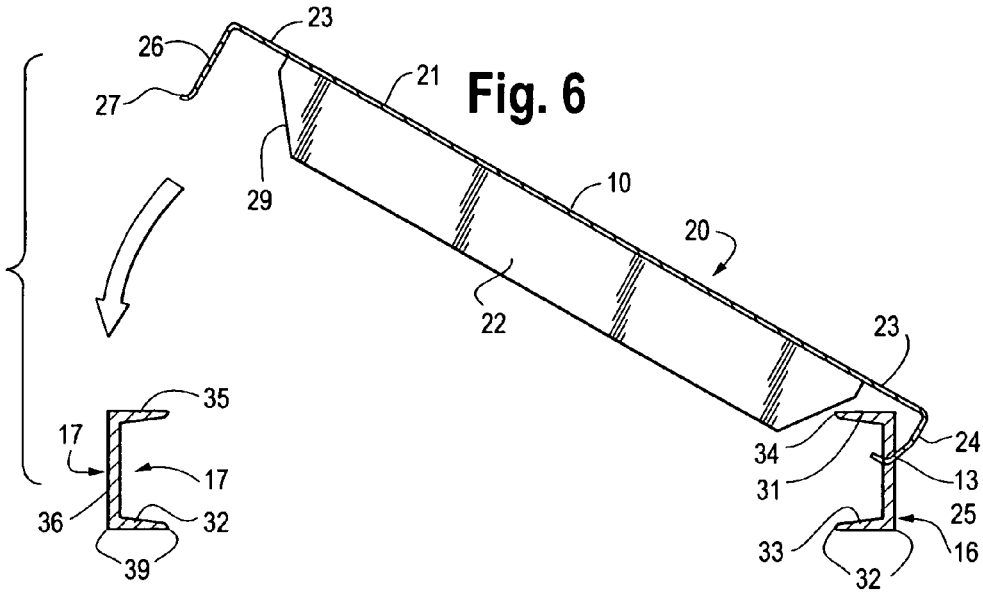
FIG. 6 is a side cross sectional view of a locking cross bar and front and back deck beams of the present invention showing the locking cross bar in an initial installation position.
Figure 7:
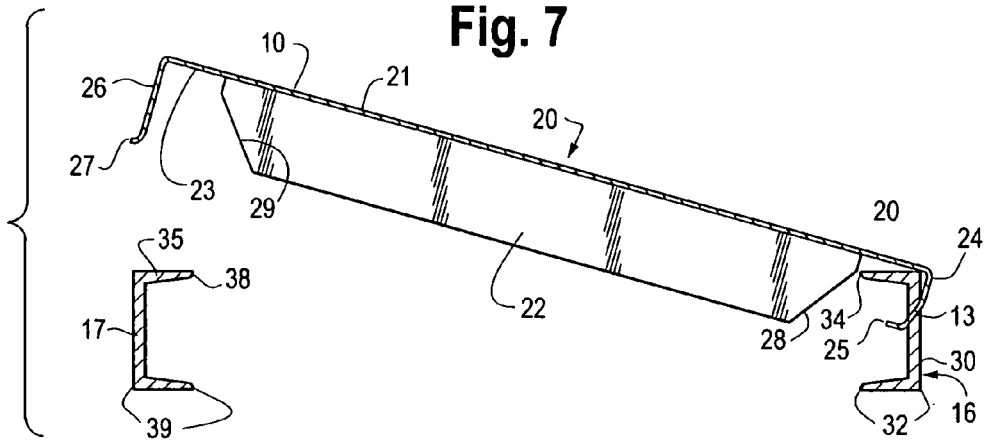
FIG. 7 is a side cross sectional view of a locking cross bar and front and back deck beams of FIG. 6 showing the locking cross bar in an intermediate installation position.
Figure 8:
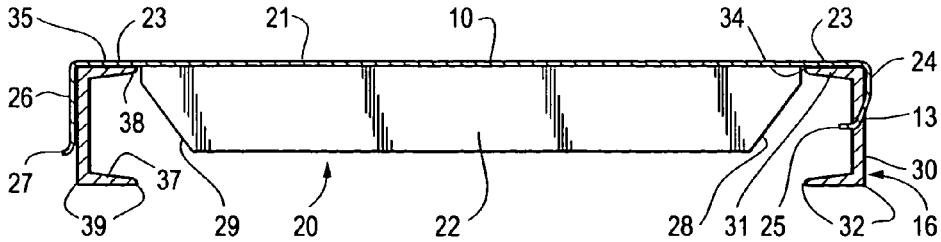
FIG. 8 is a side cross sectional view of a preferred locking cross bar and front and back deck beams of FIGS. 6 and 7, showing the locking cross bar in an installed position.
Figure 9:
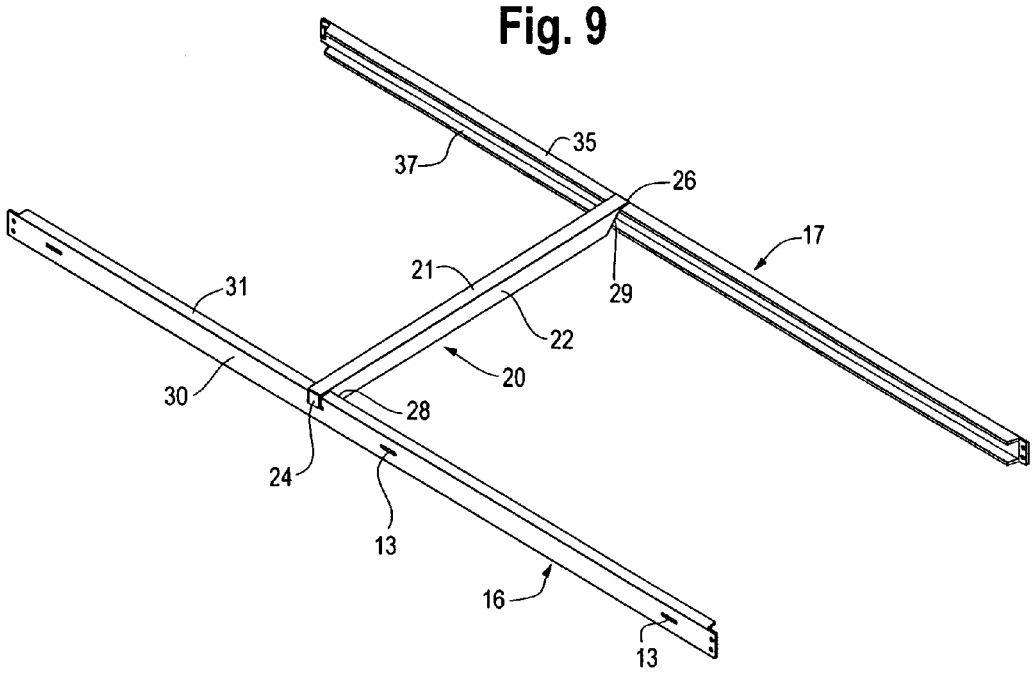
FIG. 9 is a side perspective view of an embodiment of the present invention shown installed between the front and rear deck beams.
Figure 10:
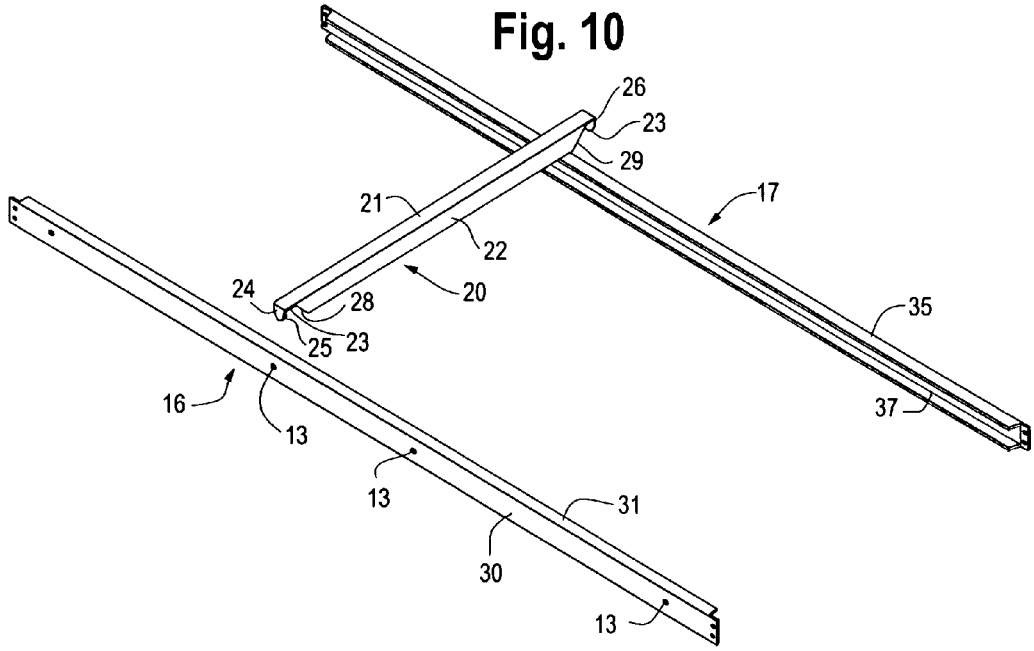
FIG. 10 is a side perspective view of a preferred embodiment of a locking cross bar shown prior to installation between front and rear deck beams.
Figure 11:
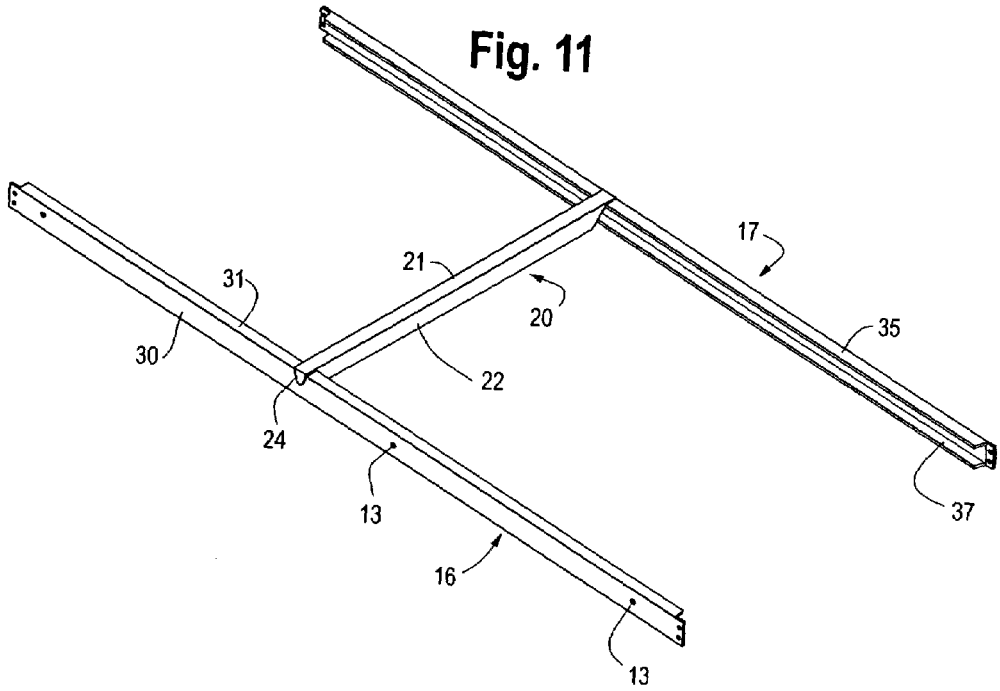
FIG. 11 is a side perspective view of the preferred embodiment of FIG. 10 shown in an installed position.
Figure 12:
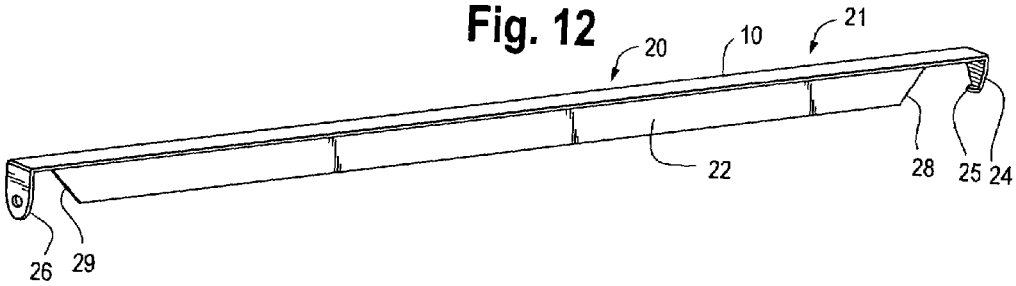
FIG. 12 is a side perspective view of a preferred embodiment of a locking cross bar of the present invention; and, FIG. 13 is a front view of the front vertical overhang of the preferred embodiment of the locking cross bar of the present invention.

When in a fully installed position (see FIG. 8), support leg portion 23 rests on the top of top flange 31. When locking cross bar 20 is in its lowered or installed position, the rear horizontal leg portion 23 rests on top flange 35 of rear deck beam 17, as shown in FIGS. 5, 8 and 9. Back vertical overhang 26 and its deflected portion 27 overhang rear deck beam 17 when locking cross bar 20 is in its lowered or installed position, and the width of back vertical overhang 26 (i.e., horizontal flange 10) prevents the rear of locking cross bar 20 from moving along a horizontal plane.

In this manner, locking cross bar 20 is locked into position between front deck beam 16 and rear deck beam 17 without the use of bolts, welds and the like. Thus, for example, if the front deck beam 16 and/or locking cross bar 20 are inadvertently hit by a fork lift placing or removing a pallet and/or its load 15, the locking cross bar 20 will remaining in place.

In addition, the locking cross bar 20 may be easily removed. When removal is desired, rear vertical overhang 26 is lifted up and rotated toward the front deck beam 16 or front of the system. Once locking cross bar 20 clears the upper flange 31 of front deck beam 16, locking tab 25 can slide out of slot 13 and locking cross bar 20 may be removed and reused, if desired.

As previously discussed, it may be desirable, but is not required, to form vertical overhang 24 at an angle slightly greater than 90%. As a result, when installed as shown in FIG. 4, a vertical gap 40 is created and is at its largest when a particular flange width 32 is the smallest. As flange width 32 increases, vertical gap 40 decreases. This helps accommodate, among other things, variations in flange widths, such as flange width 32.

Similarly, it may be desired, but is not required, that locking tab 25 be bent slightly upward, which results in top slot gap 42. Like vertical gap 40, slot gap 42 is largest when flange width 32 is at its smallest, as shown in FIG. 4. Slot gap 42 decreases as flange width 32 increases. This aids in installation and also helps secure cross bar 20.

Figure 13:
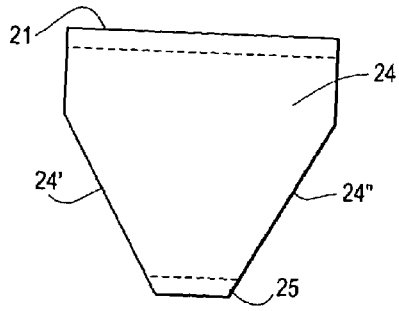

The preferred or best representative embodiment of the present invention is shown in FIGS. 10, 11, 12 and 13. In this preferred embodiment, front vertical overhang 24 optionally has a more narrow, or tapered, configuration when viewed from the front as shown in FIG. 13. More specifically, front vertical overhang 24 has tapered sides $\mathbf{24}^{1}$ and $\mathbf{24}^{11}$ that may be cut away as part of the forming process of cross bar 20. In addition, locking tab 25 is not hook shaped, but instead is flat and roughly horizontal. And, in this embodiment, apertures or slots 13 may be smaller holes or the like. Other than vertical overhang 24 having tapered sides $\mathbf{24}^{1}$ and $\mathbf{24}^{11}$ and a straight locking tab 25, the configuration, installation and/or removal of this preferred embodiment of locking cross bar 20 is essentially the same as the other embodiments discussed herein.

Also consistent with the present inventions, the rear end, as opposed to the front end, or even both ends of locking cross bar 20 may include locking means or tabs 25 and engage holes or slots 13 on both the front 16 and/or rear 17 aisle beams, as appropriate.

The above description is not intended to limit the meaning of the words used in or the scope of the following claims that define the invention. Rather, it is contemplated that future modifications in structure, function or result will exist that are not substantial changes and that all such insubstantial changes in what is claimed are intended to be covered by the claims. Thus, while preferred embodiments of the present inventions have been illustrated and described, it will be understood that changes and modifications can be made without departing from the claimed invention.

Various features of the present inventions are set forth in the following claims.

What is claimed is:

1. A shelf-type storage rack system having improved locking cross bars comprising:

at least one pair of parallel spaced front columns;

at least one pair of parallel spaced rear columns;

at least one generally horizontal front deck beam interconnected between the at least one pair of spaced front columns, the front deck beam including an outer face, and an upper flange, the entire upper width of which defines an upper support width for at least one locking cross bar, and at least one aperture in said outer face;

at least one generally horizontal rear deck beam interconnected between the at least two rear columns, the rear deck beam including an outer face and an upper flange, the entire upper width of which defines an upper support width for said at least one locking cross bar; and said at least one locking cross bar interconnecting said front and rear deck beams to form a support surface, said locking cross bar having a front end and adapted at a front end to include a vertical overhanging portion having a locking tab to lockingly engage the at least one aperture on said outer face of the at least one front deck beam, be supported by said upper support width of said front deck beam, and, having a rear end being adapted at a rear end to include a vertical overhanging portion that overhangs and is supported by said upper support width of said rear deck beam.

2. The invention of claim 1 wherein the rear end of said locking cross bar is adapted to lockingly engage a slot and be supported by said rear deck beam.

3. The invention of claim 1 wherein the front end of said locking cross bar includes a vertical overhang portion, said vertical overhang portion being tapered.

4. A shelf-type storage rack comprising:

at least one pair of spaced, parallel front columns;

at least one pair of spaced, parallel rear columns;

at least one front deck beam spanning between said front columns, said front deck beam having an outer face which is adapted to include an aperture and an upper support width;

at least one rear deck beam spanning between said rear columns, said rear deck beam having an outer face and an upper flange, the entire upper width of which defines an upper support width for at least one cross bar; and said at least one cross bar spanning between said front and said rear deck beams and forming a support surface, said cross bar having a front end that includes a vertical overhang portion with a locking tab to lockingly engage said aperture on said outer face of said front deck beam and having a rear end to engage said upper support width of said rear deck beam, said cross bar being supported by said upper support widths of said front and rear deck beams.

5. The invention of claim 4 wherein said front vertical overhang portion is tapered.

6. The invention of claim 4 wherein said locking tab is hooked.

7. The invention of claim 4 wherein said locking tab is flat.

8. The invention of claim 4 wherein the rear end of said cross bar has a rear vertical overhang portion.

9. The invention of claim 8 wherein said outer face of said rear deck beam includes at least one aperture and said rear vertical overhang portion of said cross bar includes a tab to engage said aperture on said rear deck beam.

10. A shelf-type storage rack system having improved locking cross bars comprising:

at least one pair of parallel spaced front columns;

at least one pair of parallel spaced rear columns;

at least one generally horizontal rear deck beam interconnected between the at least one pair of spaced rear columns, the rear deck beam including an outer face, an upper support width and at least one aperture in said outer face;

at least one generally horizontal front deck beam interconnected between the at least two front columns, the front deck beam including an outer face and an upper support width; and at least one locking cross bar interconnecting said front and rear deck beams to form a support surface, said locking cross bar having a rear end and adapted at said rear end to include a vertical overhanging portion having a locking tab to lockingly engage the at least one aperture on said outer face of the at least one rear deck beam, be supported by said support width of said rear deck beam, and, having a front end being adapted at said front end to include a vertical overhanging portion that overhangs and is supported by said upper support width of said front deck beam.

11. The invention of claim 10 wherein the front end of said locking cross bar is adapted to lockingly engage a slot and be supported by said rear deck beam.

12. The invention of claim 10 wherein the rear end of said locking cross bar includes a vertical overhang portion, said vertical overhang portion being tapered.

* * * * *